US008253630B2

(12) United States Patent
Tu

(10) Patent No.: US 8,253,630 B2
(45) Date of Patent: Aug. 28, 2012

(54) MICROSTRIP ANTENNA

(75) Inventor: Hsin-Lung Tu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 316 days.

(21) Appl. No.: 12/699,252

(22) Filed: Feb. 3, 2010

(65) Prior Publication Data

US 2010/0302121 A1 Dec. 2, 2010

(30) Foreign Application Priority Data

Jun. 2, 2009 (CN) ..... 2009 1 0302835

(51) Int. Cl.
*H01Q 1/38* (2006.01)

(52) U.S. Cl. ..... 343/700 MS; 343/846

(58) Field of Classification Search ..... 343/700 MS, 343/846, 848
See application file for complete search history.

(56) References Cited

U.S. PATENT DOCUMENTS

| | | | | |
|---|---|---|---|---|
| 6,747,600 | B2 * | 6/2004 | Wong et al. | 343/700 MS |
| 7,649,497 | B2 * | 1/2010 | Yamada et al. | 343/700 MS |
| 2008/0062044 | A1 | 3/2008 | Al-Mahdawi | |
| 2010/0283688 | A1 * | 11/2010 | Kinezos et al. | 343/702 |
| 2011/0025576 | A1 * | 2/2011 | Mao et al. | 343/843 |

* cited by examiner

*Primary Examiner* — Hoanganh Le
(74) *Attorney, Agent, or Firm* — Altis Law Group, Inc.

(57) ABSTRACT

A microstrip antenna located on a substrate with a first surface and a second surface opposite to the first surface includes a feeding portion, a grounding portion, and a radiating portion. The feeding portion is located on the first surface of the substrate to feed electromagnetic signals. The grounding portion is located on the second surface of the substrate. The radiating portion is located on the first surface and includes a first radiating part, a second radiating part, a third radiating part, and a fourth radiating part. Each of the first radiating part, the second radiating part, and the third radiating part is on a rectangle-shaped strip line. The first radiating part is connected to the feeding portion. The fourth radiating part is perpendicularly connected to a second end of the third radiating part.

19 Claims, 16 Drawing Sheets

MICROSTRIP ANTENNA

BACKGROUND

1. Technical Field

Embodiments of the present disclosure relate to antennas, and more particularly to a microstrip antenna.

2. Description of Related Art

In the field of wireless communication, different wireless standards cover different frequency bands. For example, the worldwide interoperability for microwave access (WIMAX) standard covers 2.3 GHz~2.4 GHz, 2.496 GHz~2.690 GHz, and 3.4 GHz~3.8 GHz, while WIFI standard covers 2.412 GHz~2.472 GHz and 5.170 GHz~5.825 GHz. Currently, a single microstrip antenna can provide only one frequency band. There is, however, a growing demand for the miniaturization of electronic wireless communication devices that can operate over more than one frequency band. Therefore, a need exists to provide a microstrip antenna with a smaller area that can operate over different frequency bands.

BRIEF DESCRIPTION OF THE DRAWINGS

The details of the disclosure, both as to its structure and operation, can best be understood by referring to the accompanying drawings, in which like reference numbers and designations refer to like elements.

DETAILED DESCRIPTION

Figure 1A:
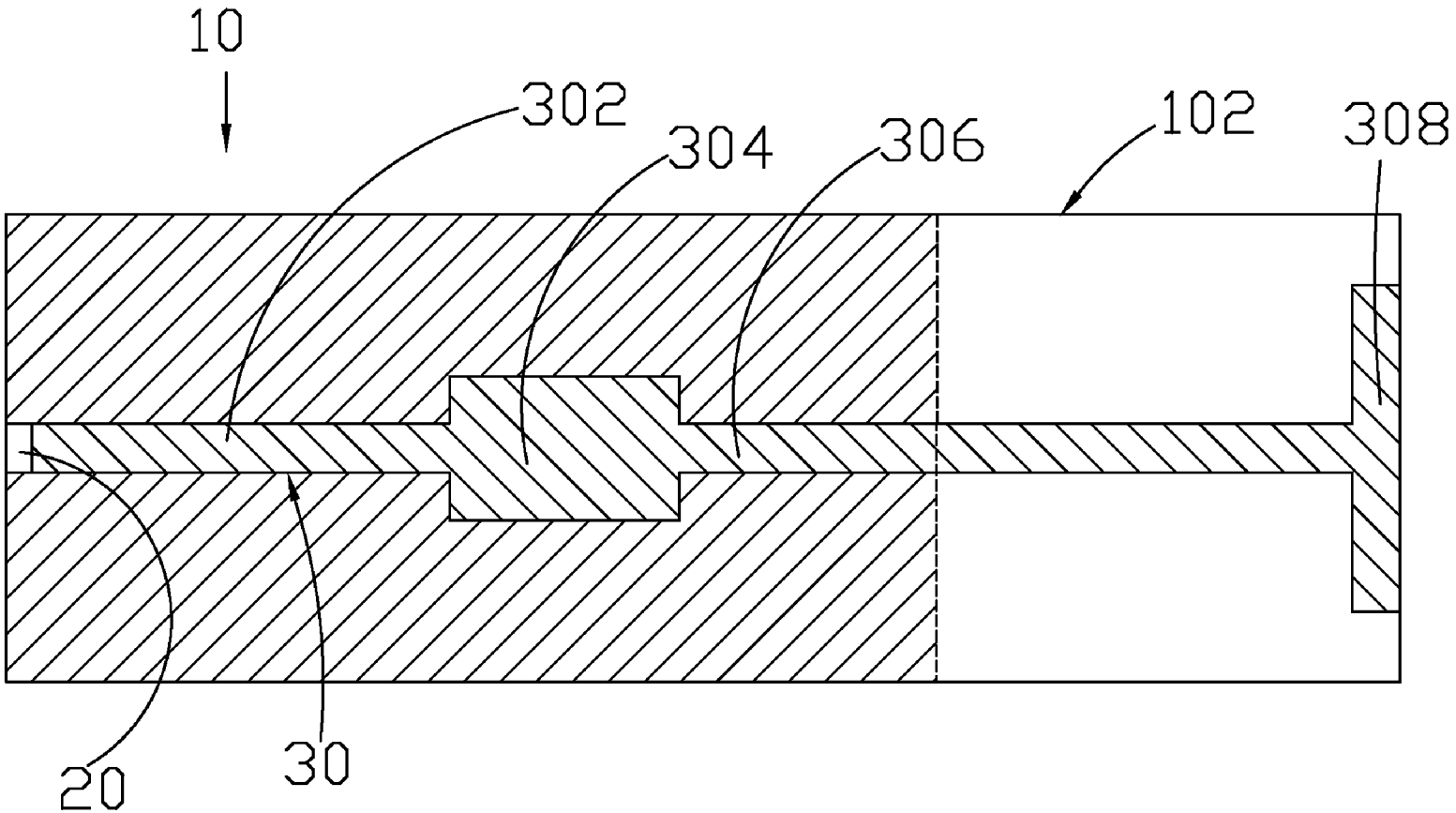
FIG. 1A and FIG. 1B are a plan view and an inverted view of one embodiment of a microstrip antenna of the present disclosure, respectively.
Figure 1B:
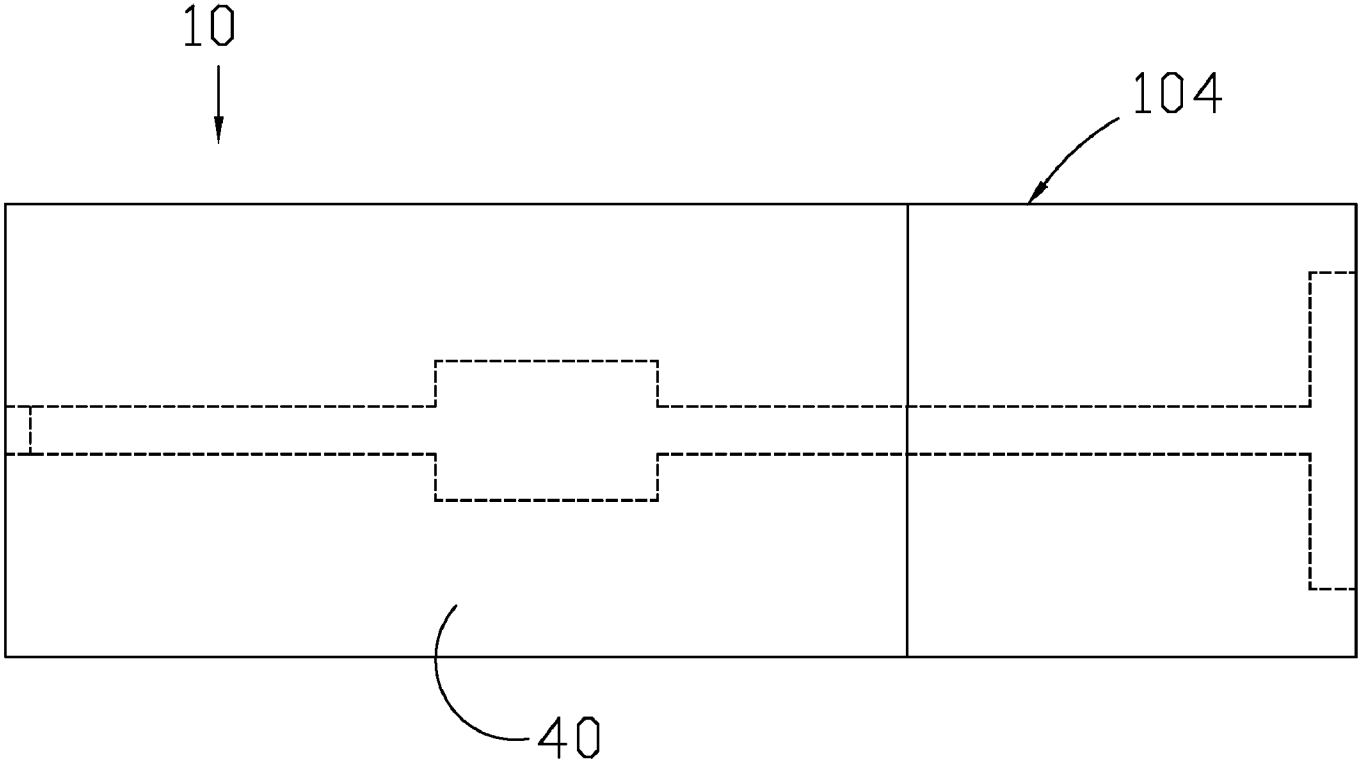

FIG. 1A and FIG. 1B are a plan view and an inverted view of one embodiment of a microstrip antenna 10 of the present disclosure, respectively. As shown, the microstrip antenna 10 is located on a substrate having a first surface 102 and a second surface 104 opposite to the first surface 102, and comprises a feeding portion 20, a radiating portion 30, and a grounding portion 40.

The feeding portion 20 is located on the first surface 102, to feed electromagnetic signals.

The radiating portion 30 is located and configured on the first surface 102 to radiate an electromagnetic signal, and comprises a first radiating part 302, a second radiating part 304, a third radiating part 306, and a fourth radiating part 308. In one embodiment, each of the first radiating part 302, the second radiating part 304, the third radiating part 306, and the fourth radiating part 308 is a rectangular strip and printed on the substrate.

In one embodiment, the first radiating part 302 with a first end connected to the feeding portion 20. A first end of the second radiating part 304 is connected to a second end of the first radiating part 302. A second end of the second radiating part 304 is connected to a first end of the third radiating part 306. In one embodiment, the first radiating part 302, the second radiating part 304, and the third radiating part 306 are arranged in series. A width of the first radiating part 302 is the same as that of the third radiating part 306. A width of the second radiating part 304 is greater than that of the first radiating part 302. In one embodiment, the first radiating part 302, the second radiating part 304, and the third radiating part 306 collectively form a substantially elongated cross-shape. The fourth radiating part 308 is perpendicularly connected to a second end of the third radiating part 306 at a substantial center of the fourth radiating part.

In one embodiment, the first radiating part 302, the second radiating part 304, the third radiating part 306, and the fourth radiating part 308 collectively form a substantial +shape, and is substantially symmetrical based on an axis of the third radiating part 306.

The grounding portion 40 is rectangularly shaped and located on the second surface 104. In one embodiment, a projection of the grounding portion 40 on the first surface 102 is fully overlapped with the first radiating part 302 and the second radiating part 304. A projection of the grounding portion 40 on the first surface 102 is partially overlapped with the third radiating part 306.

Figure 2:
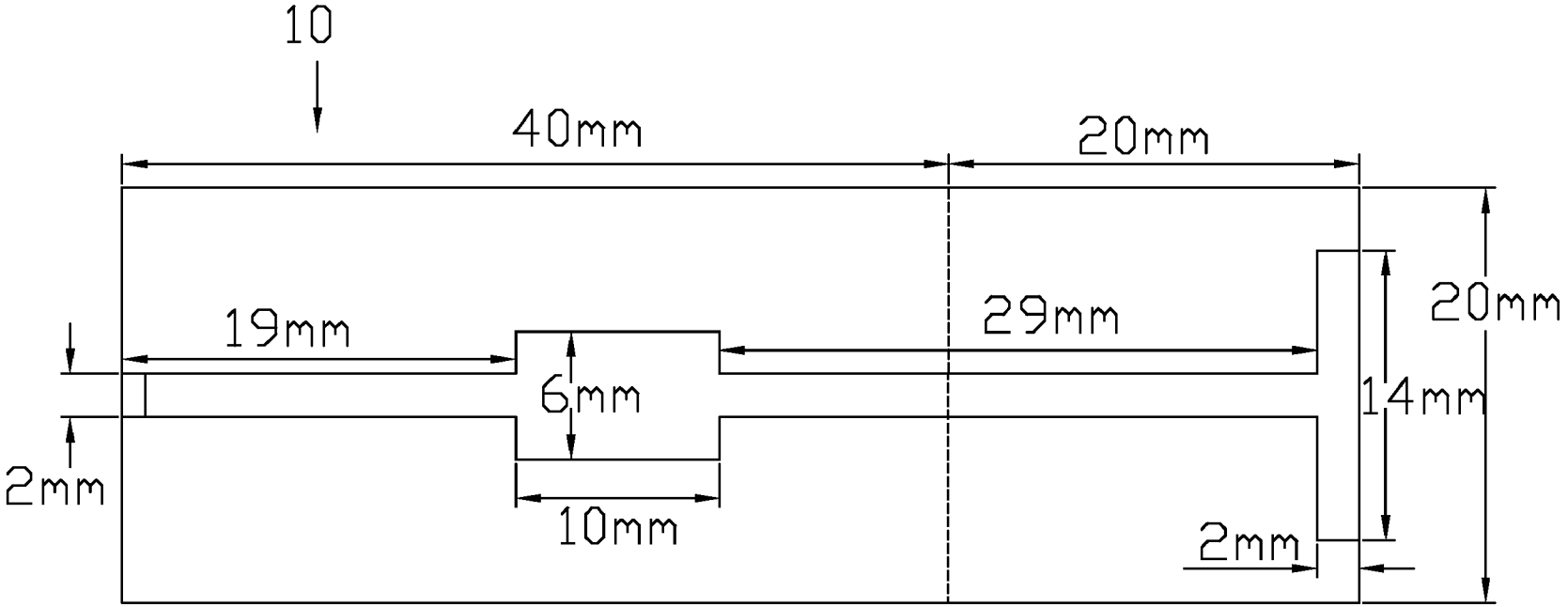
FIG. 2 illustrates one exemplary embodiment of dimensions of the microstrip antenna of FIG. 1A and FIG. 1B.

FIG. 2 illustrates one exemplary embodiment of dimensions of the microstrip antenna 10 of FIG. 1A and FIG. 1B. In one embodiment, if a wavelength of a low frequency band covered by the microstrip antenna 10 is $\lambda_1$, then a length of the radiating portion 30 is substantially equal to $\lambda_1$. In other words, $\lambda_1$ is substantially equal to a sum of a length of the first radiating part 302, a length of the second radiating part 304, a length of the third radiating part 306, and a width of the fourth radiating part 308. In one embodiment, if a wavelength of a high frequency band covered by the microstrip antenna 10 is $\lambda_2$, then a length of the fourth radiating part 308 is substantially equal to a quarter of $\lambda_2$.

In one embodiment, the substrate is a FR4 type circuit board, and a length and a width of the substrate are substantially equal to 60 mm and 20 mm, respectively. The length and a width of the first radiating part 302 are substantially equal to 19 mm and 2 mm, respectively. The length and a width of the second radiating part 304 are substantially equal to 10 mm and 6 mm, respectively. The length and a width of the third radiating part 306 are substantially equal to 29 mm and 2 mm, respectively. The length and the width of the fourth radiating part 308 are substantially equal to 14 mm and 2 mm, respectively. A length and a width of the grounding portion 40 are substantially equal to 40 mm and 20 mm, respectively. In other embodiments, if the substrate is a circuit board with another type, then the substrate may have different dimensions according to the above design theory.

Figure 3:
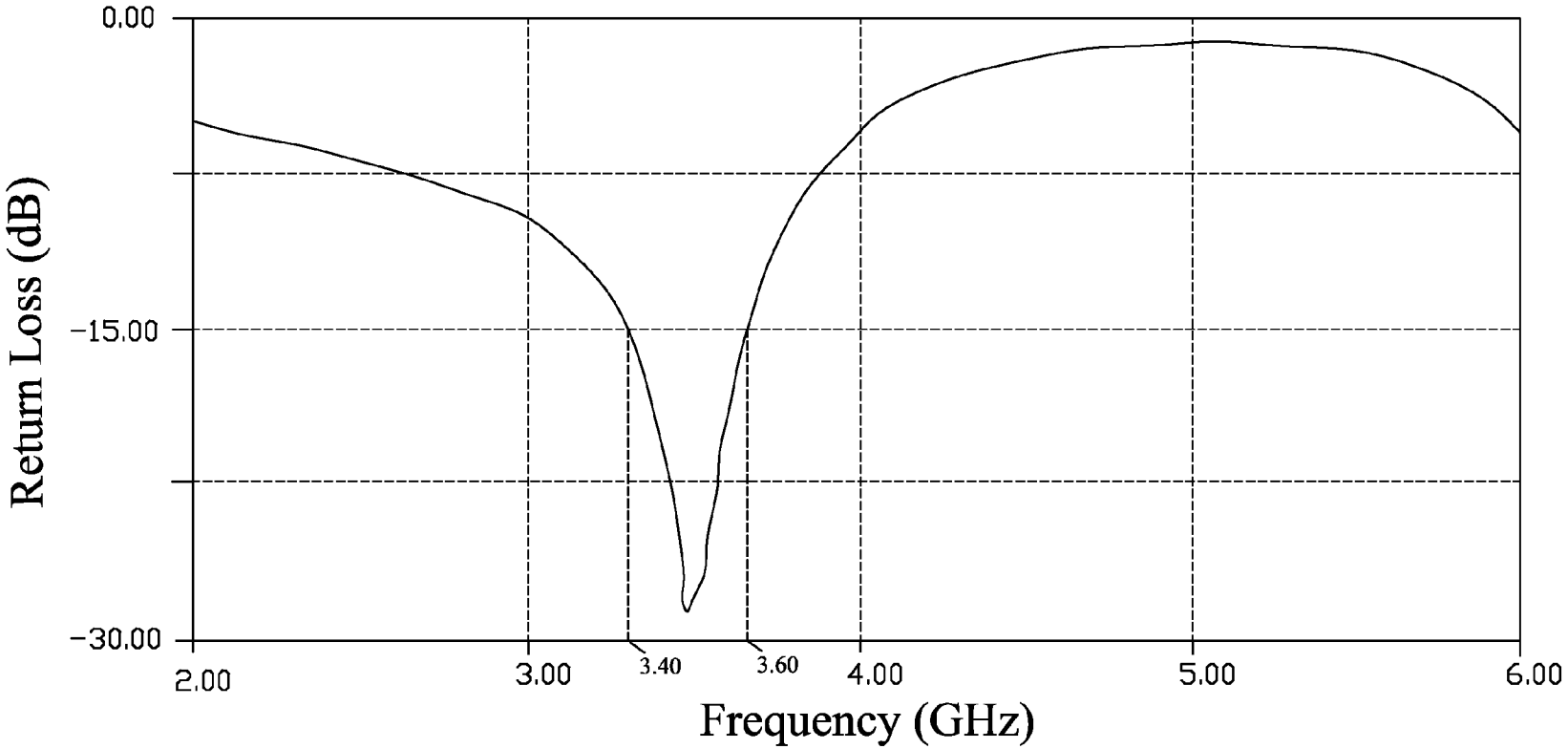
FIG. 3 is a graph showing a return loss of the microstrip antenna of FIG. 1A and FIG. 1B with the dimensions in FIG. 2.

FIG. 3 is a graph showing a return loss of the microstrip antenna 10 of FIG. 1A and FIG. 1B with the dimensions in FIG. 2. As shown, a frequency band covered by the microstrip antenna 10 with a return loss less than −10 dB is 3.4 GHz~3.6 GHz.

Figure 4:
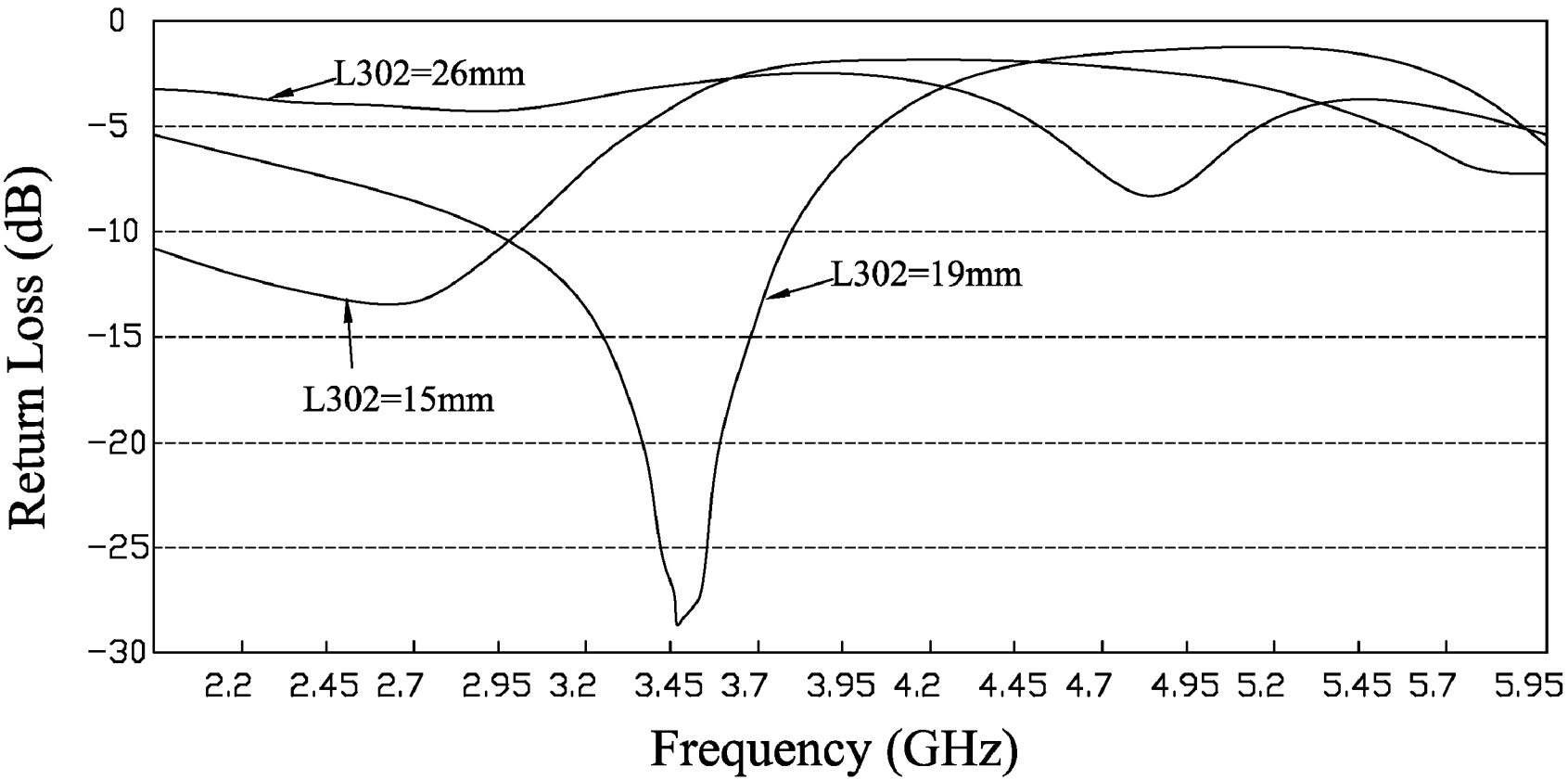
FIG. 4 is a comparison graph showing a return loss of the microstrip antenna of FIG. 1A and FIG. 1B with different lengths of a first radiating part.

FIG. 4 is a comparison graph showing a return loss of the microstrip antenna 10 FIG. 1A and FIG. 1B with different lengths of the first radiating part 302. As shown, when the length of the first radiating part 302 is substantially equal to 15 mm, frequency bands covered by the microstrip antenna 10 with a return loss less than −10 dB include 2.3 GHz~2.4 GHz, 2.496 GHz~2.690 GHz on the WIMAX standard, and 2.412 GHz~2.472 GHz on the Wi-Fi standard. When the length of the first radiating part 302 is equal to 19 mm, a frequency band covered by the microstrip antenna 10 with a return loss less than −10 dB includes 3.4 GHz~3.8 GHz on the WiMAX standard. As shown, the microstrip antenna 10 designed above can cover different frequency bands by changing the length of the first radiating part 302 on the premise that the microstrip antenna 10 conforms to an industry standard of a return loss less than −10 dB.

Figure 5:
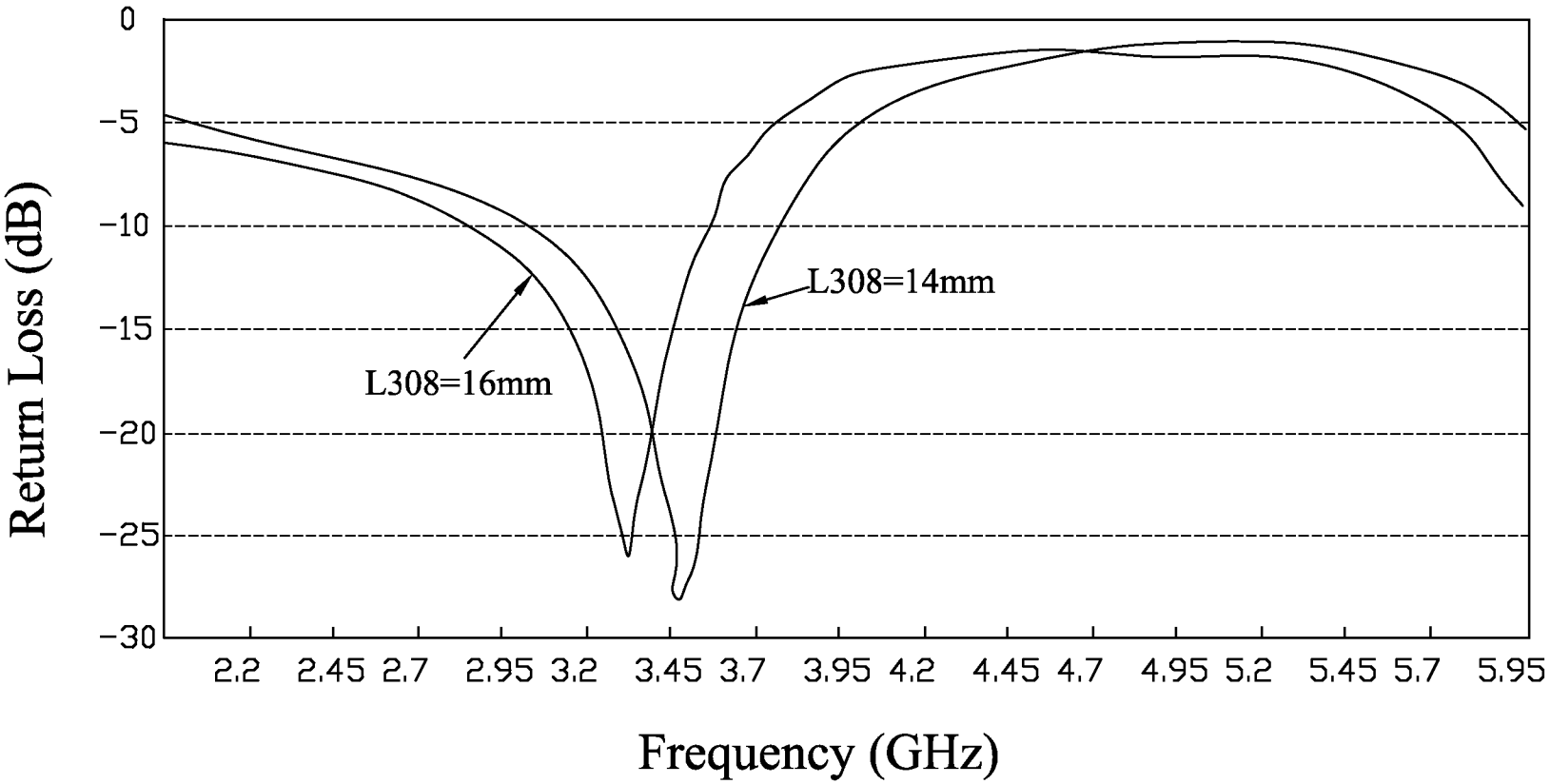
FIG. 5 is a comparison graph showing a return loss of the microstrip antenna of FIG. 1A and FIG. 1B with different lengths of a fourth radiating part.

FIG. 5 is a comparison graph showing a return loss of the microstrip antenna 10 of FIG. 1A and FIG. 1B with different lengths of the fourth radiating part 308. As shown, the microstrip antenna 10 designed above can cover different frequency bands by changing the length of the fourth radiating part 308 on the premise that the microstrip antenna 10 conforms to an industry standard of a return loss less than −10 dB.

Figure 6A:
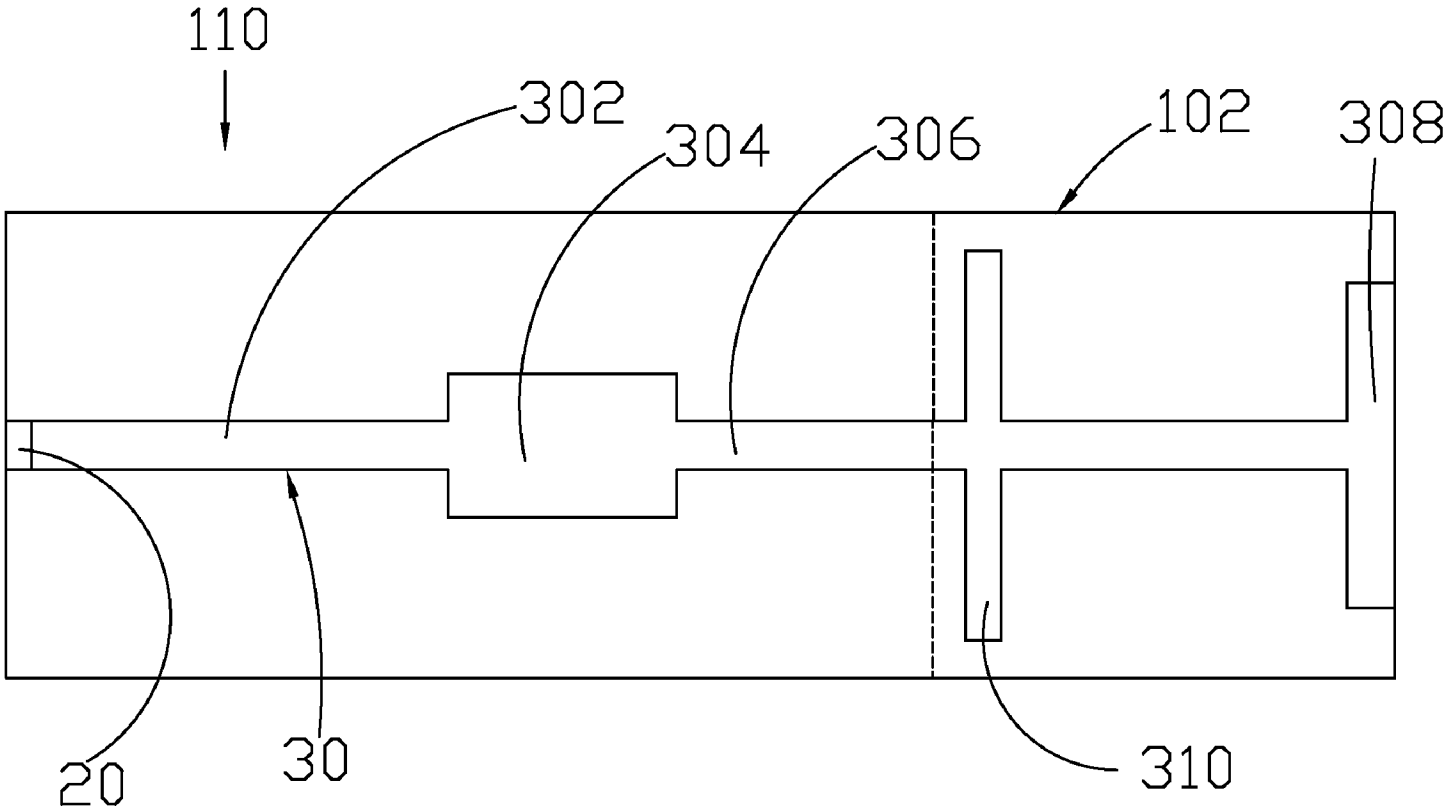
FIG. 6A and FIG. 6B are a plan view and an inverted view of a microstrip antenna of another embodiment of the present disclosure, respectively.
Figure 6B:
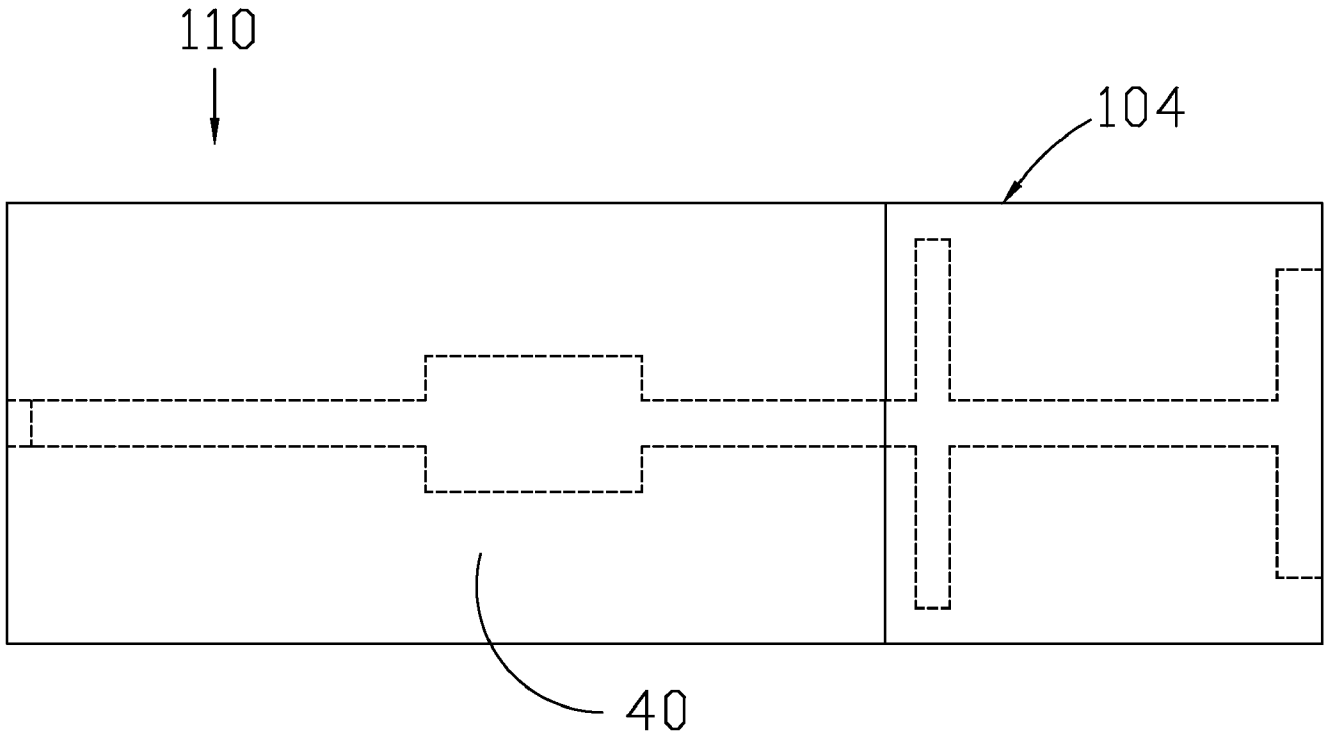

FIG. 6A and FIG. 6B are a plan view and an inverted view of a microstrip antenna 110 of another embodiment of the present disclosure, respectively. In one embodiment, the microstrip antenna 110 is similar to the microstrip antenna 10 of FIGS. 1A and 1B, the difference being, that the microstrip antenna 110 further includes a fifth radiating part 310. The fifth radiating part 310 of rectangular strip perpendicularly connects to the third radiating part 306. In one embodiment, the fifth radiating part 310 is located between the second radiating part 304 and the fourth radiating part 308, and substantially symmetrical based on an axis of the third radiating part 306.

Figure 7:
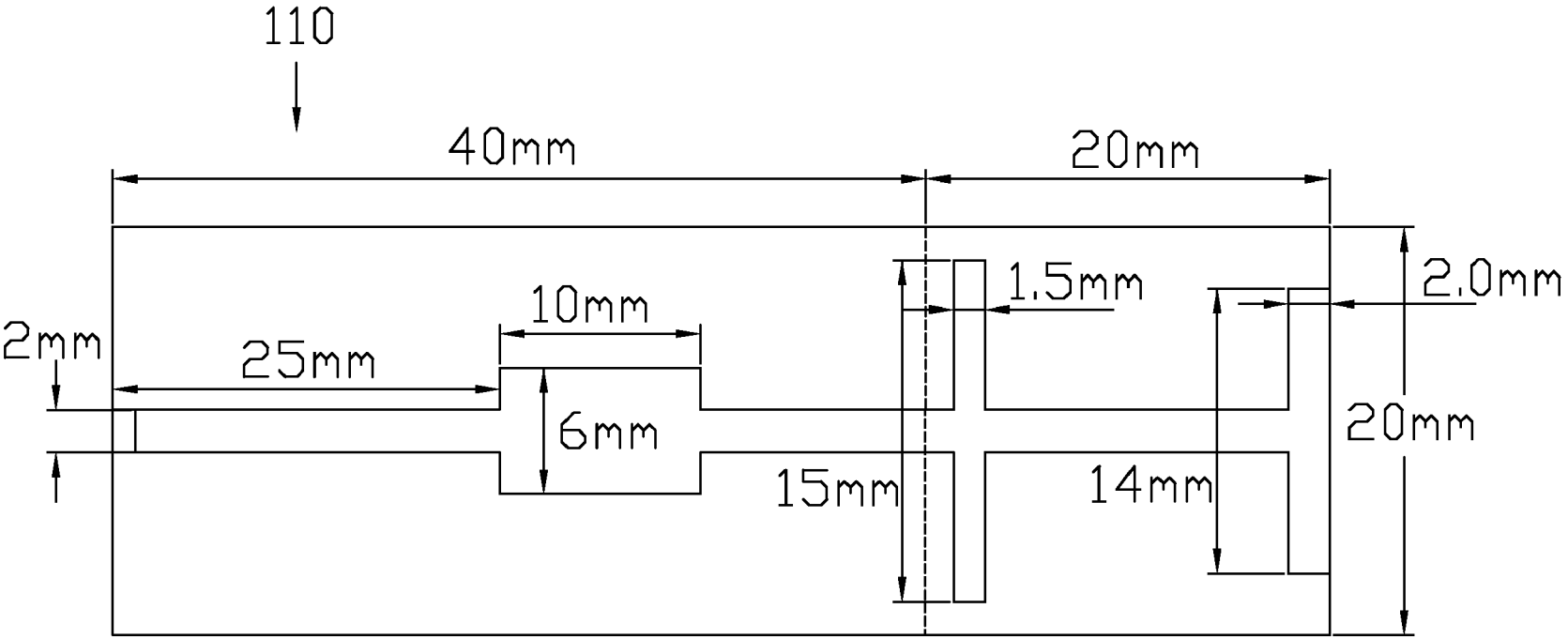
FIG. 7 illustrates one exemplary embodiment of dimensions of the microstrip antenna of FIG. 6A and FIG. 6B.

FIG. 7 illustrates one exemplary embodiment of dimensions of the microstrip antenna 110 of FIG. 6A and FIG. 6B. In one embodiment, the substrate is a FR4 type circuit board, and a length and a width of the substrate are substantially equal to 60 mm and 20 mm, respectively. The length and the width of the first radiating part 302 are substantially equal to 25 mm and 2 mm, respectively. The length and the width of the second radiating part 304 are substantially equal to 10 mm and 6 mm, respectively. The length and the width of the third radiating part 306 are substantially equal to 23 mm and 2 mm, respectively. The length and the width of the fourth radiating part 308 are substantially equal to 14 mm and 2 mm, respectively. The length and the width of the fifth radiating part 310 are substantially equal to 15 mm and 1.5 mm, respectively. The length and the width of the grounding portion 40 are substantially equal to 40 mm and 20 mm, respectively.

Figure 8:
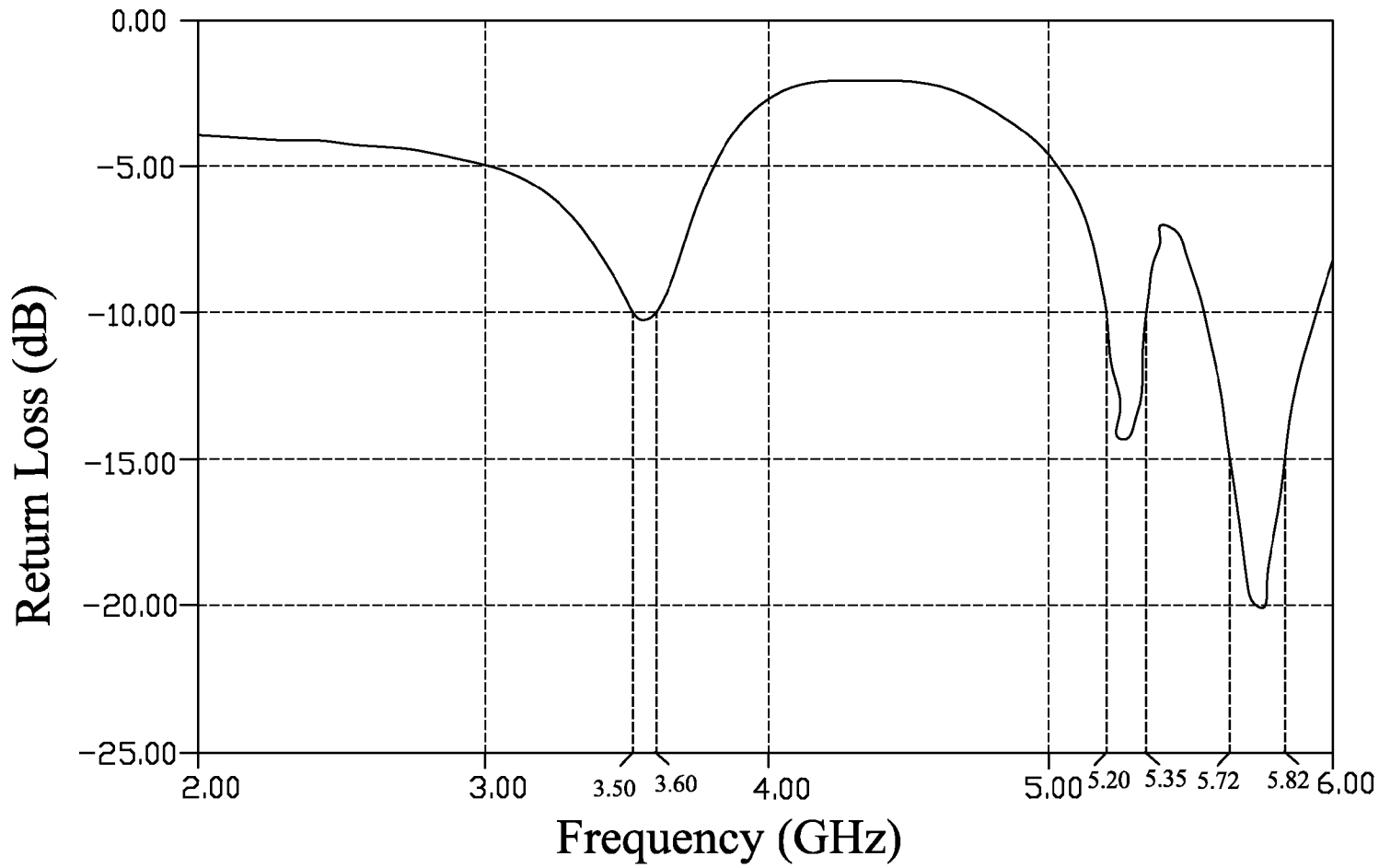
FIG. 8 is a graph showing a return loss of the microstrip antenna of FIG. 6A and FIG. 6B with dimensions of FIG. 7.

FIG. 8 is a graph showing a return loss of the microstrip antenna 110 of FIG. 6A and FIG. 6B with dimensions of FIG. 7. As shown, frequency bands covered by the microstrip antenna 110 with a return loss less than −10 dB include 3.5 GHz~3.6 GHz on the WIMAX standard, and 5.20 GHz~5.35 GHz and 5.72 GHz~5.82 GHz on the Wi-Fi standard. As shown, the microstrip antenna 110 designed above can cover different frequency bands by adding the fifth radiating part 310, on the premise that the microstrip antenna 110 conforms to an industry standard of a return loss less than −10 dB.

Figure 9:
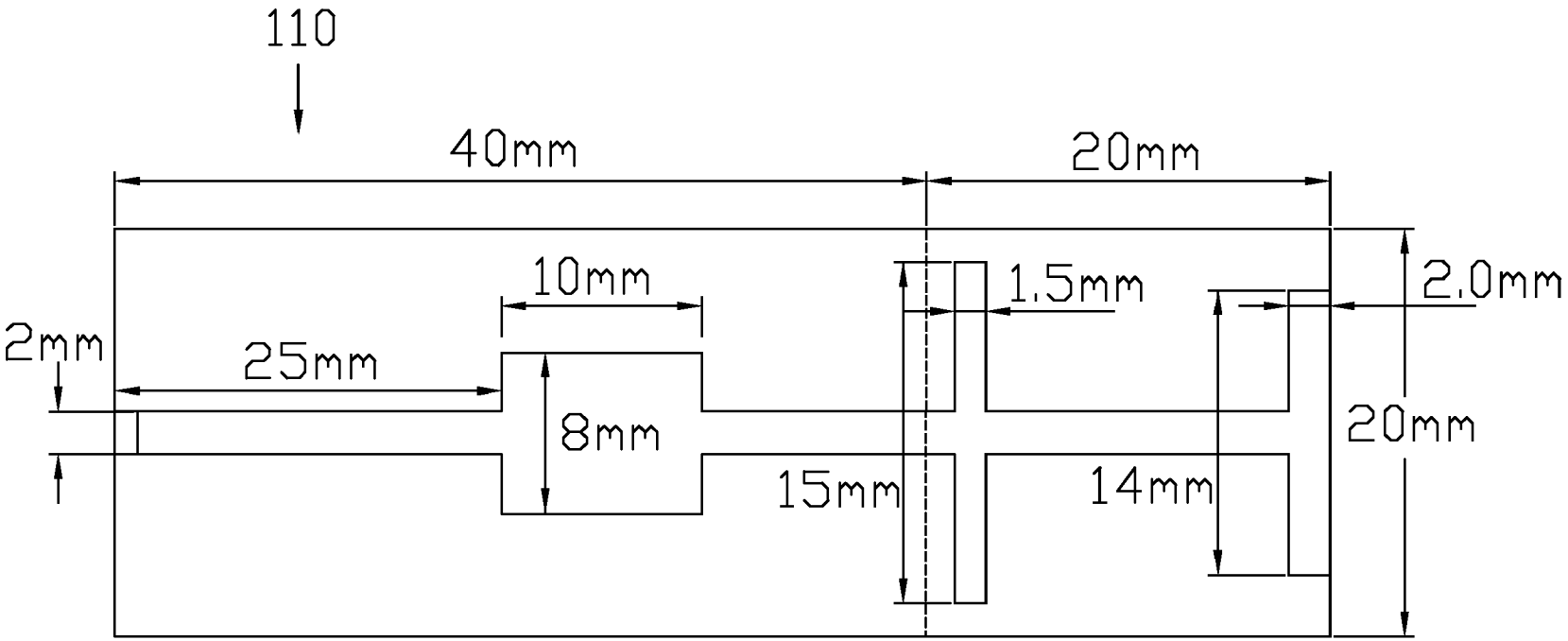
FIG. 9 illustrates another exemplary embodiment of dimensions of the microstrip antenna of FIG. 6A and FIG. 6B.

FIG. 9 illustrates another exemplary embodiment of dimensions of the microstrip antenna 110 of FIG. 6A and FIG. 6B with a changed area of the second radiating part 304. In one embodiment, The length and the width of the second radiating part 304 are substantially equal to 10 mm and 8 mm, respectively. The other dimensions of the microstrip antenna 110 are the same as FIG. 7.

Figure 10:
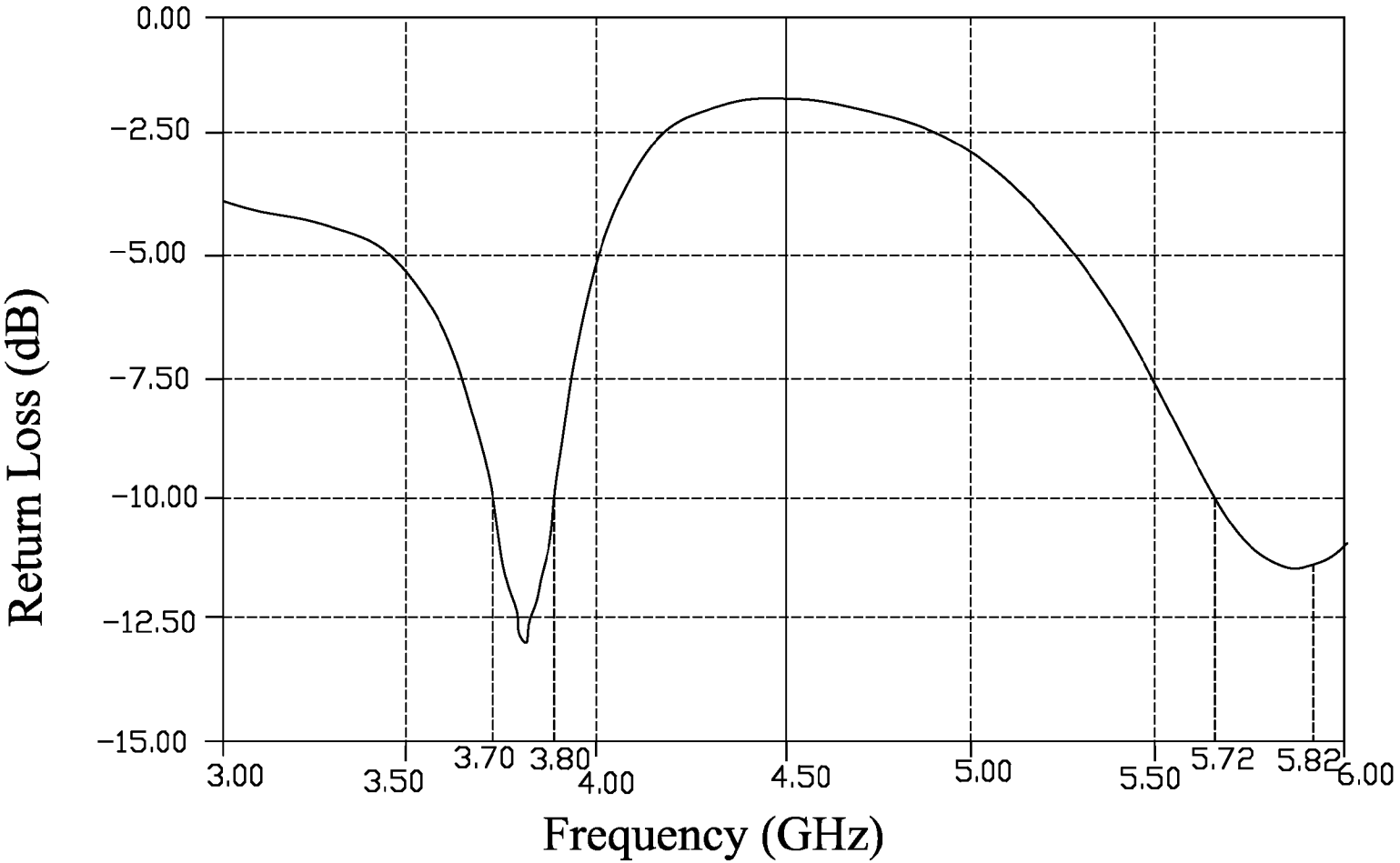
FIG. 10 is a graph showing a return loss of the microstrip antenna of FIG. 6A and FIG. 6B having the dimension given in FIG. 9.

FIG. 10 is a graph showing a return loss of the microstrip antenna 110 of FIG. 6A and FIG. 6B with the dimensions given in FIG. 9. As shown, frequency bands covered by the microstrip antenna 110 with a return loss less than −10 dB include 3.7 GHz~3.8 GHz on the MIMAX standard, and 5.72 GHz~5.82 GHz on the Wi-Fi standard. Contrasting FIG. 8 and FIG. 10, the microstrip antenna 110 designed above can cover different frequency bands by changing the area of the second radiating part 304 on the premise that the microstrip antenna 110 conforms to an industry standard of a return loss less than −10 dB.

Figure 11A:
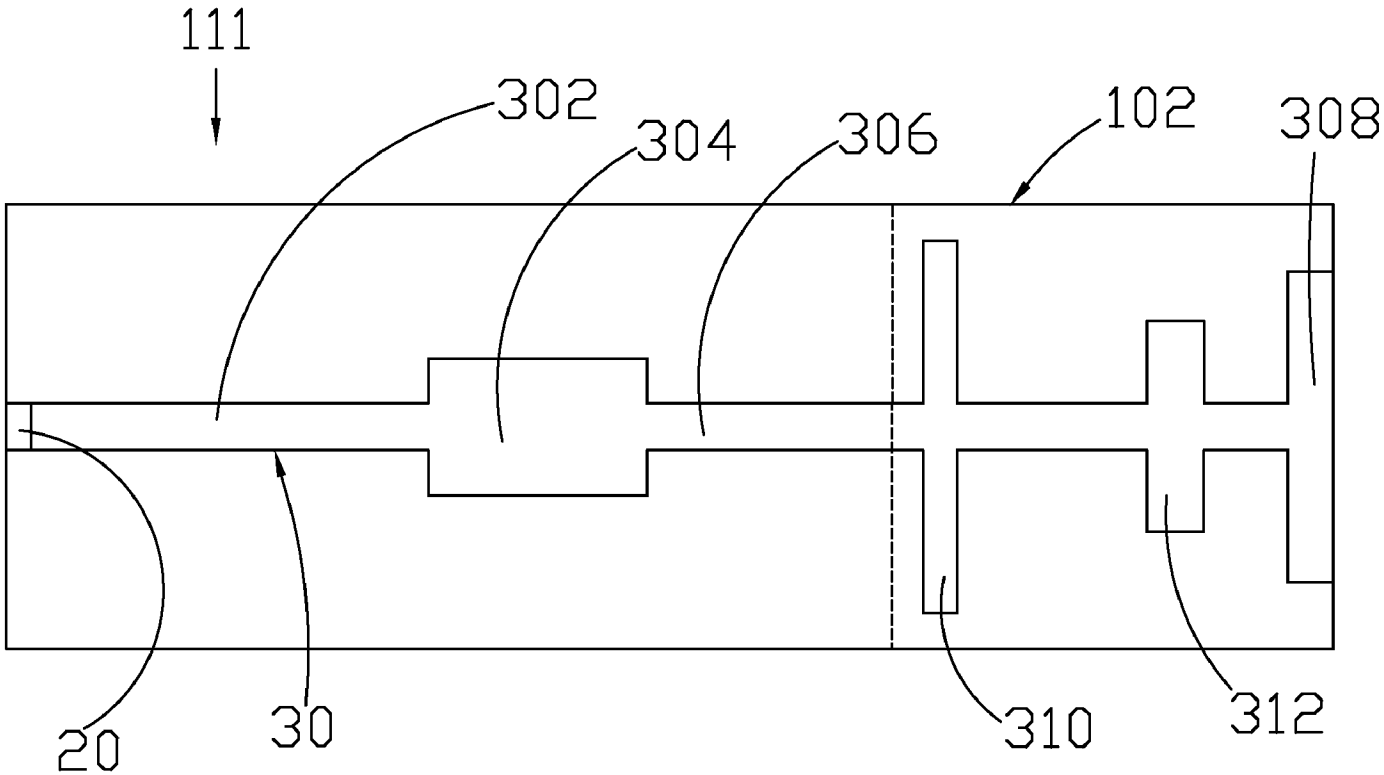
FIG. 11A and FIG. 11B are a plan view and an inverted view of a microstrip antenna of a further embodiment of the present disclosure, respectively.
Figure 11B:
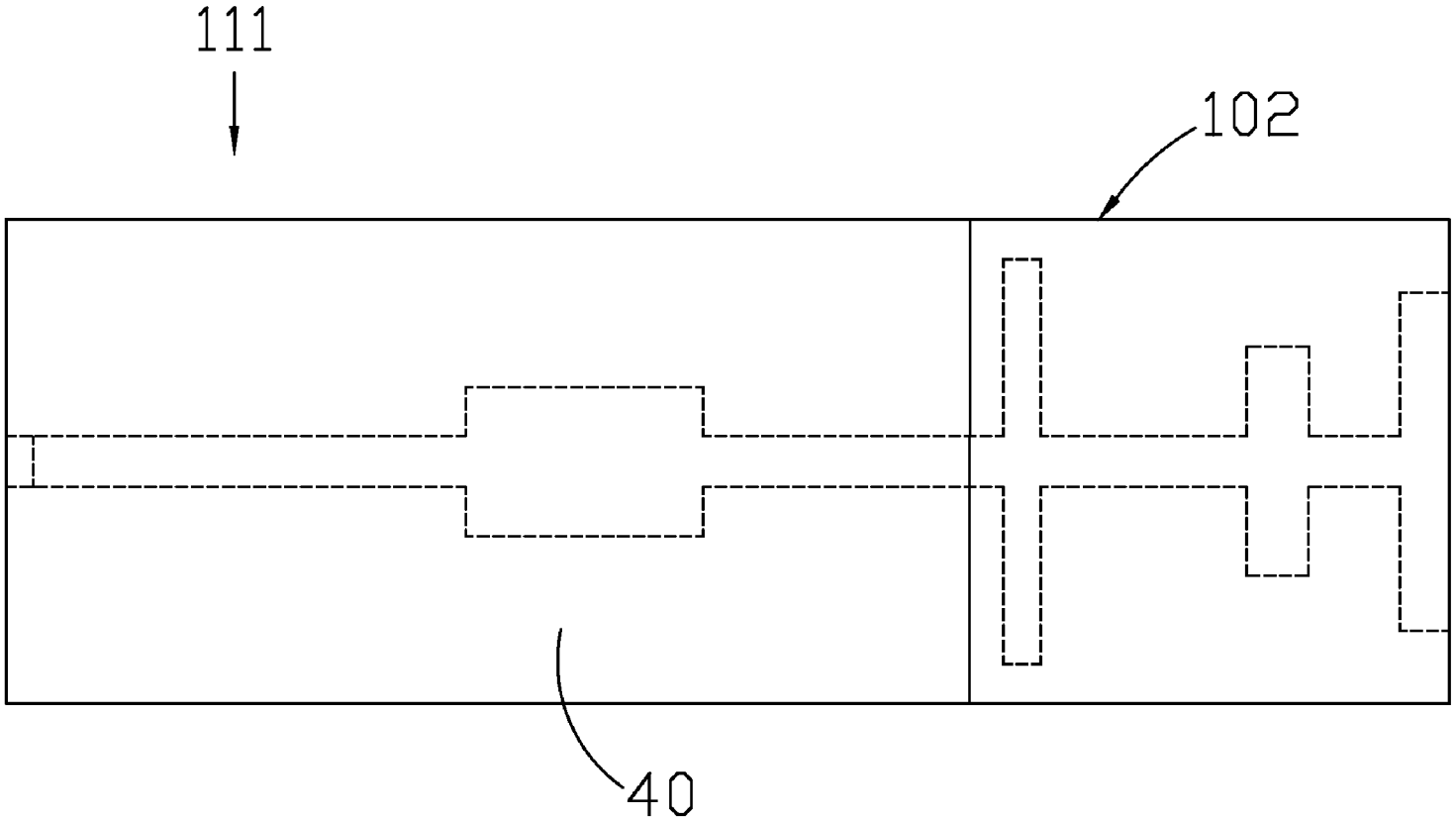

FIG. 11A and FIG. 11B are a plan view and an inverted view of a microstrip antenna 111 of a further embodiment of the present disclosure, respectively. In one embodiment, the microstrip antenna 111 is similar to the microstrip antenna 110 of FIG. 6A and FIG. 6B, the difference being that the microstrip antenna 111 further includes a sixth radiating part 312. The sixth radiating part 312 is a rectangular strip perpendicularly connected to the third radiating part 306. In one embodiment, the sixth radiating part 312 is located between the fourth radiating part 308 and the fifth radiating part 310, and substantially symmetrical based on an axis of the third radiating part 306.

In one embodiment, the first radiating part 302, the second radiating part 304, the third radiating part 306, the fourth radiating part 308, the fifth radiating part 310, and the sixth radiating part 312 collectively form a substantially 圭shape, and is substantially symmetrical based on an axis of the third radiating part 306.

Figure 12:
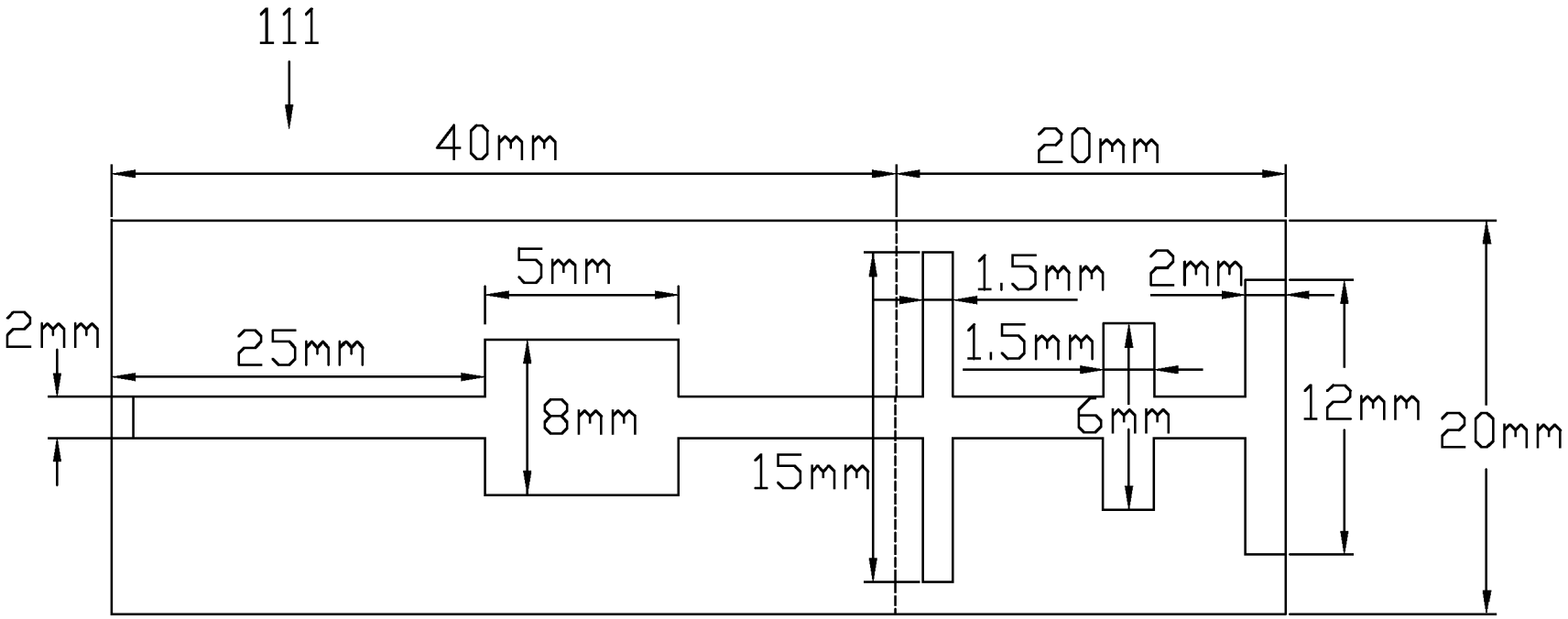
FIG. 12 illustrates one exemplary embodiment of dimensions of the microstrip antenna of FIG. 11A and FIG. 11B.

FIG. 12 illustrates one exemplary embodiment of dimensions of the microstrip antenna 111 of FIG. 11A and FIG. 11B. In one embodiment, the substrate is a circuit board with a type of FR4, and the length and the width of the substrate are substantially equal to 60 mm and 20 mm, respectively. The length and the width of the first radiating part 302 are substantially equal to 25 mm and 2 mm, respectively. The length and the width of the second radiating part 304 are substantially equal to 5 mm and 8 mm, respectively. The length and the width of the third radiating part 306 are substantially equal to 28 mm and 2 mm, respectively. The length and the width of the fourth radiating part 308 are substantially equal to 12 mm and 2 mm, respectively. The length and the width of the fifth radiating part 310 are substantially equal to 15 mm and 1.5 mm, respectively. The length and the width of the sixth radiating part 312 are substantially equal to 6 mm and 1.5 mm, respectively. The length and the width of the grounding portion 40 are substantially equal to 40 mm and 20 mm, respectively.

Figure 13:
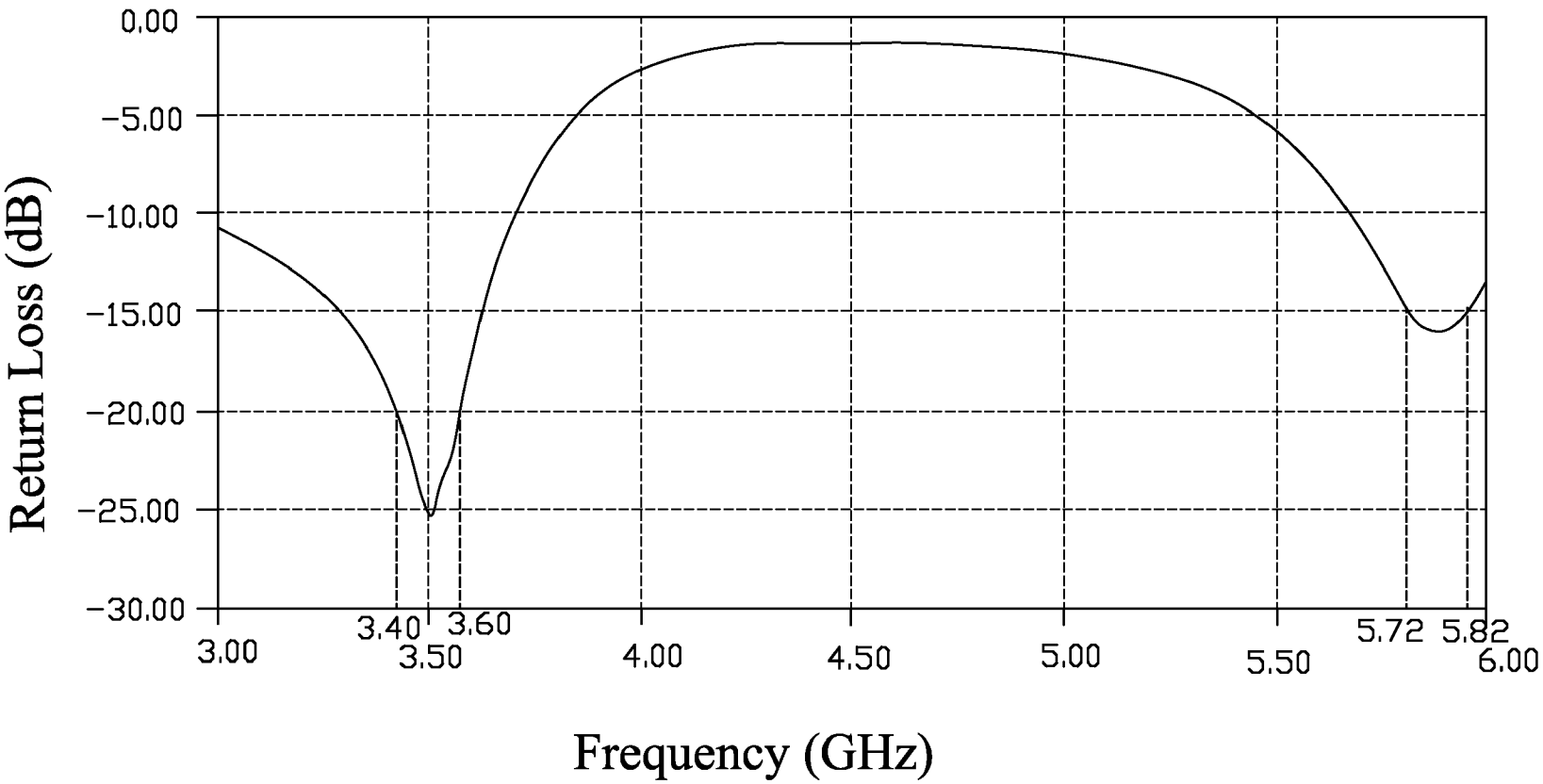
FIG. 13 is a graph showing a return loss of the microstrip antenna of FIG. 11A and FIG. 11B.

FIG. 13 is a graph showing a return loss of the microstrip antenna 111 of FIG. 11A and FIG. 11B. As shown, frequency bands covered by the microstrip antenna 111 with a return loss less than −10 dB include 3.40 GHz~3.60 GHz on the MIMAX standard, and 5.72 GHz~5.82 GHz on the Wi-Fi standard. As shown, the microstrip antenna 111 designed above can cover different frequency bands by adding the sixth radiating part 312 on the premise that the microstrip antenna 111 conforms to an industry standard of a return loss less than −10 dB.

In one embodiment, the microstrip antenna 10, the microstrip antenna 110, and the microstrip antenna 111 not only cover more frequency bands, but also significantly improve the return loss to meet different requirements by changing the length of the first radiating part 302, or the length of the fourth radiating part 308, or by adding the fifth radiating part 310, or the sixth radiating part 312.

While various embodiments and methods of the present disclosure have been described, it should be understood that they have been presented by example only and not by limitation. Thus the breadth and scope of the present disclosure should not be limited by the above-described embodiments, but should be defined only in accordance with the following claims and their equivalents.

What is claimed is:

1. A microstrip antenna located on a substrate having a first surface and a second surface opposite to the first surface, the microstrip antenna comprising:

a feeding portion located on the first surface of the substrate, to feed electromagnetic signals;

a radiating portion located on the first surface of the substrate, to radiate an electromagnetic signal, the radiating portion comprising:

a first radiating part of rectangular strip with a first end connected to the feeding portion;

a second radiating part of rectangular strip with a first end connected to a second end of the first radiating part, wherein a width of the second radiating part is greater than that of the first radiating part;

a third radiating part of rectangular strip with a first end connected to a second end of the second radiating part, wherein a width of the third radiating part is the same as that of the first radiating part, and the first radiating part, the second radiating part, and the third radiating part are arranged in series; and a fourth radiating part of rectangular strip perpendicularly connected to a second end of the third radiating part, at a substantial center of the fourth radiating part;

a grounding portion located on the second surface of the substrate and rectangularly shaped;

wherein a width of the second radiating part that is parallel to an axis of the third radiating part is greater than a width of the fourth radiating part that is parallel to the axis of the third radiating part; and wherein a width of the fourth radiating part that is perpendicular to the axis of the third radiating part is greater than a width of the second radiating part that is perpendicular to the axis of the third radiating part.

2. The microstrip antenna as claimed in claim 1, wherein the first radiating part, the second radiating part, the third radiating part, and the fourth radiating part collectively form a substantial ±shape.

3. The microstrip antenna as claimed in claim 1, wherein the radiating portion is substantially symmetrical based on the axis of the third radiating part.

4. The microstrip antenna as claimed in claim 1, wherein the radiating portion further comprises a fifth radiating part of rectangular strip perpendicularly connected to the third radiating part.

5. The microstrip antenna as claimed in claim 4, wherein the fifth radiating part is located between the second radiating part and the fourth radiating part, and substantially symmetrical based on the axis of the third radiating part.

6. The microstrip antenna as claimed in claim 5, wherein the radiating portion further comprises a sixth radiating part of rectangular strip perpendicularly connected to the third radiating part and shaped in a rectangle.

7. The microstrip antenna as claimed in claim 6, wherein the sixth radiating part is located between the fourth radiating part and the fifth radiating part, and substantially symmetrical based on the axis of the third radiating part.

8. The microstrip antenna as claimed in claim 6, wherein the first radiating part, the second radiating part, the third radiating part, the fourth radiating part, the fifth radiating part, and the sixth radiating part collectively form a substantial ±shape and substantially symmetrical based on the axis of the third radiating part.

9. The microstrip antenna as claimed in claim 1, wherein the substrate is a FR4 type circuit board.

10. The microstrip antenna as claimed in claim 1, wherein a projection of the grounding portion on the first surface is fully overlapped with the first radiating part and the second radiating part, and partially overlapped with the third radiating part.

11. A microstrip antenna located on a substrate having a first surface and a second surface opposite to the first surface, the microstrip antenna comprising:

a feeding portion located on the first surface of the substrate, to feed electromagnetic signals;

a radiating portion located on the first surface of the substrate, to radiate an electromagnetic signal, the radiating portion comprising:

a first radiating part of rectangular strip with a first end connected to the feeding portion;

a second radiating part of rectangular strip with a first end connected to a second end of the first radiating part, wherein a width of the second radiating part is greater than that of the first radiating part;

a third radiating part of rectangular strip with a first end connected to a second end of the second radiating part, wherein a width of the third radiating part is the same as that of the first radiating part, and the first radiating part, the second radiating part, and the third radiating part are arranged in series;

a fourth radiating part of rectangular strip perpendicularly connected to a second end of the third radiating part, at a substantial center of the fourth radiating part;

a fifth radiating part of rectangular strip perpendicularly connected to the third radiating part; and a grounding portion located on the second surface of the substrate and rectangularly shaped.

12. The microstrip antenna as claimed in claim 11, wherein the radiating portion is substantially symmetrical based on an axis of the third radiating part.

13. The microstrip antenna as claimed in claim 12, wherein a width of the second radiating part that is parallel to the axis of the third radiating part is greater than a width of the fourth radiating part that is parallel to the axis of the third radiating part, wherein a width of the fourth radiating part that is perpendicular to the axis of the third radiating part is greater than a width of the second radiating part that is perpendicular to the axis of the third radiating part, wherein the first radiating part, the second radiating part, the third radiating part, and the fourth radiating part collectively form a substantial ±shape.

14. The microstrip antenna as claimed in claim 13, wherein the fifth radiating part is located between the second radiating part and the fourth radiating part, wherein a width of the fifth radiating part that is perpendicular to the axis of the third radiating part is greater than the width of the fourth radiating part that is perpendicular to the axis of the third radiating part, wherein the third radiating part, the fourth radiating part, the fifth radiating part collectively form a substantial ±shape.

15. A microstrip antenna located on a substrate having a first surface and a second surface opposite to the first surface, the microstrip antenna comprising:

a feeding portion located on the first surface of the substrate, to feed electromagnetic signals;

a radiating portion located on the first surface of the substrate, to radiate an electromagnetic signal, the radiating portion comprising:

a first radiating part of rectangular strip with a first end connected to the feeding portion;

a second radiating part of rectangular strip with a first end connected to a second end of the first radiating part, wherein a width of the second radiating part is greater than that of the first radiating part;

a third radiating part of rectangular strip with a first end connected to a second end of the second radiating part, wherein a width of the third radiating part is the same as that of the first radiating part, and the first radiating part, the second radiating part, and the third radiating part are arranged in series;

a fourth radiating part of rectangular strip perpendicularly connected to a second end of the third radiating part, at a substantial center of the fourth radiating part;

a fifth radiating part of rectangular strip perpendicularly connected to the third radiating part;

a sixth radiating part of rectangular strip perpendicularly connected to the third radiating part and shaped in a rectangle; and a grounding portion located on the second surface of the substrate and rectangularly shaped.

16. The microstrip antenna as claimed in claim 15, wherein the radiating portion is substantially symmetrical based on an axis of the third radiating part.

17. The microstrip antenna as claimed in claim 16, wherein a width of the second radiating part that is parallel to the axis of the third radiating part is greater than a width of the fourth radiating part that is parallel to the axis of the third radiating part, wherein a width of the fourth radiating part that is perpendicular to the axis of the third radiating part is greater than a width of the second radiating part that is perpendicular to the axis of the third radiating part, wherein the first radiating part, the second radiating part, the third radiating part, and the fourth radiating part collectively form a substantial ⊥shape.

18. The microstrip antenna as claimed in claim 17, wherein the fifth radiating part is located between the second radiating part and the fourth radiating part, wherein a width of the fifth radiating part that is perpendicular to the axis of the third radiating part is greater than the width of the fourth radiating part that is perpendicular to the axis of the third radiating part, wherein the third radiating part, the fourth radiating part, the fifth radiating part collectively form a substantial ±shape.

19. The microstrip antenna as claimed in claim 18, wherein the sixth radiating part is located between the fourth radiating part and the fifth radiating part, wherein the width of the fourth radiating part that is perpendicular to the axis of the third radiating part is greater than a width of the sixth radiating part that is perpendicular to the axis of the third radiating part, wherein the first radiating part, the second radiating part, the third radiating part, the fourth radiating part, the fifth radiating part, and the sixth radiating part collectively form a substantial ±shape.

* * * * *